US010711555B2

(12) United States Patent
Norbom

(10) Patent No.: US 10,711,555 B2
(45) Date of Patent: Jul. 14, 2020

(54) WELLBORE CONTROL DEVICE

(71) Applicant: ELECTRICAL SUBSEA & DRILLING AS, Straume (NO)

(72) Inventor: Erik Norbom, Hoevik (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 7 days.

(21) Appl. No.: 15/576,705

(22) PCT Filed: May 25, 2016

(86) PCT No.: PCT/EP2016/061804
§ 371 (c)(1),
(2) Date: Nov. 23, 2017

(87) PCT Pub. No.: WO2016/189034
PCT Pub. Date: Dec. 1, 2016

(65) Prior Publication Data

US 2018/0135376 A1 May 17, 2018

(30) Foreign Application Priority Data

May 26, 2015 (GB) ..... 1508907.1

(51) Int. Cl.
*E21B 33/06* (2006.01)

(52) U.S. Cl.
CPC ..... *E21B 33/063* (2013.01)

(58) Field of Classification Search
CPC .... E21B 33/063; E21B 33/062; E21B 33/061; E21B 33/06
See application file for complete search history.

(56) References Cited

U.S. PATENT DOCUMENTS 3,561,526 A * 2/1971 Williams, Jr. ..... E21B 29/08 166/55
4,537,250 A * 8/1985 Troxell, Jr. ..... E21B 29/08 166/55

(Continued)

FOREIGN PATENT DOCUMENTS

EP 1 865 145 A1 12/2007
WO WO 2012/000098 A1 1/2012

(Continued)

*Primary Examiner* — Craig J Price
*Assistant Examiner* — Andrew J Rost
(74) *Attorney, Agent, or Firm* — Norman B. Thot

(57) ABSTRACT

A wellbore control device includes a housing defining a throughbore which can receive a tubular, a first gate with a first hole, and a second gate with a second hole. The first gate and the second gate are supported by the housing and and can perform a movement transverse to the throughbore between an open position and a closed position. The movement of the first gate and the second gate from the open position to the closed position splits the throughbore into an upper portion and a lower portion, the upper position and the lower positing being completely separate from each other. The first hole and the second hole are aligned substantially co-axially with the throughbore in the open position. A part of at least one of the first hole and the second hole remains aligned with the throughbore in the closed position.

24 Claims, 7 Drawing Sheets

(56) References Cited

U.S. PATENT DOCUMENTS

| | | | | |
|---|---|---|---|---|
| 5,515,916 | A * | 5/1996 | Haley | E21B 29/08 166/55 |
| 6,454,015 | B1 * | 9/2002 | Armstrong | E21B 29/04 166/373 |
| 8,353,338 | B2 * | 1/2013 | Edwards | F16K 3/029 166/85.4 |
| 8,567,490 | B2 * | 10/2013 | Van Winkle | E21B 33/063 166/85.4 |
| 8,770,274 | B2 * | 7/2014 | Van Winkle | E21B 33/063 166/85.4 |
| 9,732,576 | B2 * | 8/2017 | Rao | E21B 33/063 |
| 2007/0278435 | A1 | 12/2007 | Wood | |
| 2013/0270466 | A1 | 10/2013 | Edwards | |
| 2014/0264099 | A1 * | 9/2014 | Melancon | E21B 33/063 251/1.1 |
| 2016/0108694 | A1 | 4/2016 | Rao et al. | |
| 2016/0138356 | A1 | 5/2016 | Ellison | |

FOREIGN PATENT DOCUMENTS

| | | | |
|---|---|---|---|
| WO | WO 2014/199184 | A2 | 12/2014 |
| WO | WO 2016/064582 | A1 | 4/2016 |

* cited by examiner

WELLBORE CONTROL DEVICE

CROSS REFERENCE TO PRIOR APPLICATIONS

This application is a U.S. National Phase application under 35 U.S.C. § 371 of International Application No. PCT/EP2016/061804, filed on May 25, 2016 and which claims benefit to Great Britain Patent Application No. 1508907.1, filed on May 26, 2015. The International Application was published in English on Dec. 1, 2016 as WO 2016/189034 A1 under PCT Article 21(2).

FIELD

The present invention relates to wellbore control devices, and more particularly to blow out preventers and related systems for closing a petroleum well, also in the presence of tools or conduits, such as a drill string, in the wellbore.

BACKGROUND

Production or exploration wells in the oil and gas industry are provided with one or more well bore control devices, such as a blow out preventer or a riser control device, for sealing the well bore in the event of an emergency in order to protect personnel and the environment. Conventional wellbore control devices have cutting rams mounted perpendicular to a vertical throughbore. The rams can be activated to sever a tubular disposed in the wellbore and to seal the well bore. The cutting rams move through a horizontal plane and are often driven by in-line piston hydraulic actuators.

Such well bore control devices must withstand extreme conditions during use, which sets stringent requirements for their design. In order for the well to be closed and sealed in an emergency, the device must be able to cut anything present in the wellbore, which can be a drilling tubular, casing, or tools for well intervention. Effective sealing is also required against what may be very high wellhead pressures.

SUMMARY

An aspect of the present invention is to provide a wellbore control device which includes a housing defining a throughbore which is configured to receive a tubular, a first gate comprising a first hole, and a second gate comprising a second hole. The first gate and the second gate are supported by the housing and and are configured to perform a movement which is transverse to the throughbore between an open position and a closed position. The movement of the first gate and the second gate from the open position to the closed position splits the throughbore into an upper portion and a lower portion, the upper position and the lower positing being completely separate from each other. In the open position, the first hole and the second hole are aligned substantially co-axially with the throughbore. In the closed position, a part of at least one of the first hole and the second hole remains aligned with the throughbore.

BRIEF DESCRIPTION OF THE DRAWINGS

The present invention is described in greater detail below on the basis of embodiments and of the drawings in which.

DETAILED DESCRIPTION

Figure 1:
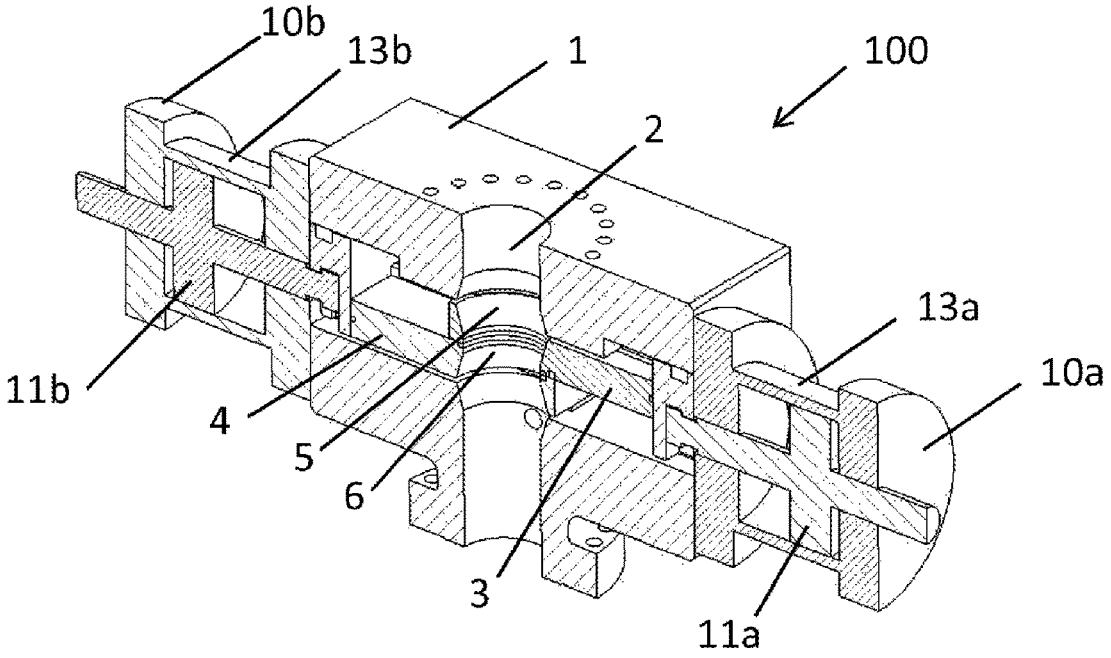
FIG. 1 shows a wellbore control device in an open position.

In an embodiment, the present invention provides a wellbore control device comprising a housing defining a throughbore, the throughbore adapted to receive a tubular, a first gate having a first hole, a second gate having a second hole, the first and second gates being supported by the housing and movable transverse to the throughbore between an open position and a closed position, whereby movement of the gates from the open to the closed position splits the throughbore into an upper portion and a completely separate lower portion, and where in the open position the first and second holes are aligned substantially co-axially with the throughbore, and in the closed position part of at least one of the first and second holes remains aligned with the throughbore.

Movement of the gates from the open position to the closed position will thus shear (sever) an object such as a tubular located in the throughbore. Permitting part of one or both of the first and second holes to remain in alignment with the throughbore in the closed position advantageously allows a part of the cut object, such as a tubular, to remain in the hole after cutting. It is thus not necessary to do a "double cut" or to have a mechanism for lifting the cut object out of the hole, as would be required for the gate to move fully into the housing in the closed position. A lifting of a drilling tubular may be extremely challenging because a tubular may extend over several hundred meters from a topside facility and the total weight may be several hundred tons. A double cut would require cutting the tubular between the gate and the housing.

A further advantage of the present invention is that gates, as opposed to conventional rams, are fully supported for loads around the throughbore. Once an object, such as a drill string, has been cut, or even during cutting, its full weight will rest on, and must be carried by, the gates. This will also be the case if the object is in compression or tension, which may equally create very high vertical loads on the cutting elements. Having gates supported by the housing avoids any bending of the gates due to forces from the cut object or splitting/separation of the gates due to cutting loads acting at the shearing point between the gates. In the case of, for example, a BOP system, the gates will thus be supported for vertical loads during the entire cutting and sealing position both from above and below.

Providing the first and second gates with first and second holes which are aligned substantially co-axially with the throughbore in the open position further allows the device to be designed with a through passage essentially without snag points. The holes can be designed essentially flush with the throughbore walls.

A further advantage of using gates with holes compared to conventional cutting rams is that this provides that the tubular (for example, the drilling pipe) will be forced to the center of the throughbore upon cutting. There is thus no risk of the cutting elements not being able to "catch" and engage the tubular. This can be a problem if, for example, the drilling pipe is forced to one side of the throughbore by tension or weight forces.

Movement from the open position to the closed position may comprise movement of the first gate in a first direction transverse to the throughbore, and movement of the second gate in a second, opposite direction transverse to the throughbore.

At least one of the first gate or the second gate is shaped so that its respective hole is frustoconical or has a frustoconical portion. In this case, each gate may be shaped so that the diameter of the hole is larger towards the side of the gate facing the housing and smaller towards the side of the gate adjacent to the other gate.

One or each of the first and second gate may be shaped so that its hole has a shearing edge which assists in shearing a tubular extending along the throughbore on movement of the gates from the open position to the closed position.

The housing may be shaped so that the throughbore has a frustoconical portion. In this case, the housing may be shaped so that the throughbore has two frustoconical portions which are arranged so that the gates are directly adjacent to and supported between the two frustoconical portions of the throughbore. The or each frustoconical portion of the throughbore has a larger diameter end and a smaller diameter end, and may be arranged with the larger diameter end directly adjacent one of the two gates and the smaller diameter end spaced from the gates.

Providing conical portions in the gates and/or in the throughbore advantageously allows more space for the cut object to remain in the hole after closing. If cutting a large-diameter tubular, such as a casing, the cut end may in particular be heavily deformed, usually into an oval shape. Providing conical portions allows such a deformed end to remain in the hole without affecting the closing function of the device.

A substantially flush through passage can be achieved by the device by providing frustoconical portions of the same dimensions in both the gates and the throughbore, thus avoiding any snag points in the open position.

The wellbore control device may further comprise seals arranged to provide a substantially fluid-tight seal between the housing and the first and second gates.

The wellbore control device may further comprise further seals arranged to provide a substantially fluid-tight seal between the first and second gates when the gates are in the closed position.

These seals may be non-metallic.

Providing non-metallic seals, such as elastomeric or polymeric seals, advantageously gives improved sealing in the closed position. A particular challenge in BOPs, for example, is that the shearing faces and surfaces are damaged during cutting. This may in particular be the case where the full weight of a drill string acts on a surface, and slides across it during closing. This may render conventional metal-to-metal seals ineffective, i.e., the device is not able to completely seal off the wellbore. Non-metallic seals are significantly more tolerant to such damaged and uneven surfaces, thereby providing more effective sealing.

The seals and/or further seals may be energized by side packer seals upon the first and second gates reaching the closed position.

Providing energizing of the seals only upon closing advantageously permits the seals to be positioned in seal grooves, wherein they are protected against any object being cut in the wellbore. Upon full, or near full, closure of the device, the seals can be energized, and thus engage the relevant face to be sealed against, for example, a housing surface or a surface on the other gate.

A seal groove may be provided on at least one of the gates, the seal groove having a semi-circular shape.

Forming a seal groove on a gate in a semi-circular shape advantageously prevents any cut objects from extending into the seal groove. In particular when cutting a tubular, the cut end will be deformed into an oval, and in particular cases, a nearly flat shape. Sliding such a cut end across a surface with a seal groove may lead to it being pushed into the seal groove and thus damaging the seal. By providing a semi-circular seal groove, the cut end finds support on other parts of the gate surface at any point when sliding across a seal groove.

The wellbore control device may further comprise slide elements arranged between the gates and the housing.

The slide elements may comprise a fluid path which extends from the hole towards a back section of the gates.

The wellbore control device may further comprise ram elements arranged between the gates and actuators.

The ram elements may advantageously be provided in a different shape and size than the gates. The ram elements may hold part of the non-metallic seals. Wellbore pressure assisted closing can be achieved by designing the ram elements with a larger back area than the gates.

A second aspect of the present invention provides an assembly comprising a wellbore control device according to the first aspect of the present invention, and a tubular which extends along the throughbore in the housing of the wellbore control device, wherein each portion of the hole or holes which remains aligned with the throughbore when the gates are in the closed position defines a connecting area with a circumferential length which is larger than the circumference of the tubular.

This advantageously allows the cut pipe end to remain in the hole and avoids a secondary cut of the tubular object between the gate and the body, or additional deformation of the cut end to force this into the hole in the closed position of the wellbore control device.

Arranging the frustoconical portions to define an area with such circumferential length also allows the wellbore control device to be used with both conventional tubing or drill string, as well as with casing (which is larger in diameter). Conventional blow out preventer rams in conventional systems cannot cut casing, there is thus a need for separate casing shear rams. The wellbore control device according to the present invention can therefore eliminate the need for such additional shear rams for casing.

A third aspect of the present invention provides a method of operating a wellbore control device according to the first aspect of the present invention to sever a tubular extending along the throughbore and through the holes in the gates, the method comprising moving the first gate in a first direction generally transverse to throughbore and moving the second gate in a second direction generally transverse to the throughbore. The first direction may be opposite to the second direction.

The present invention will now be described in greater detail below under reference to the drawings.

Figure 2:
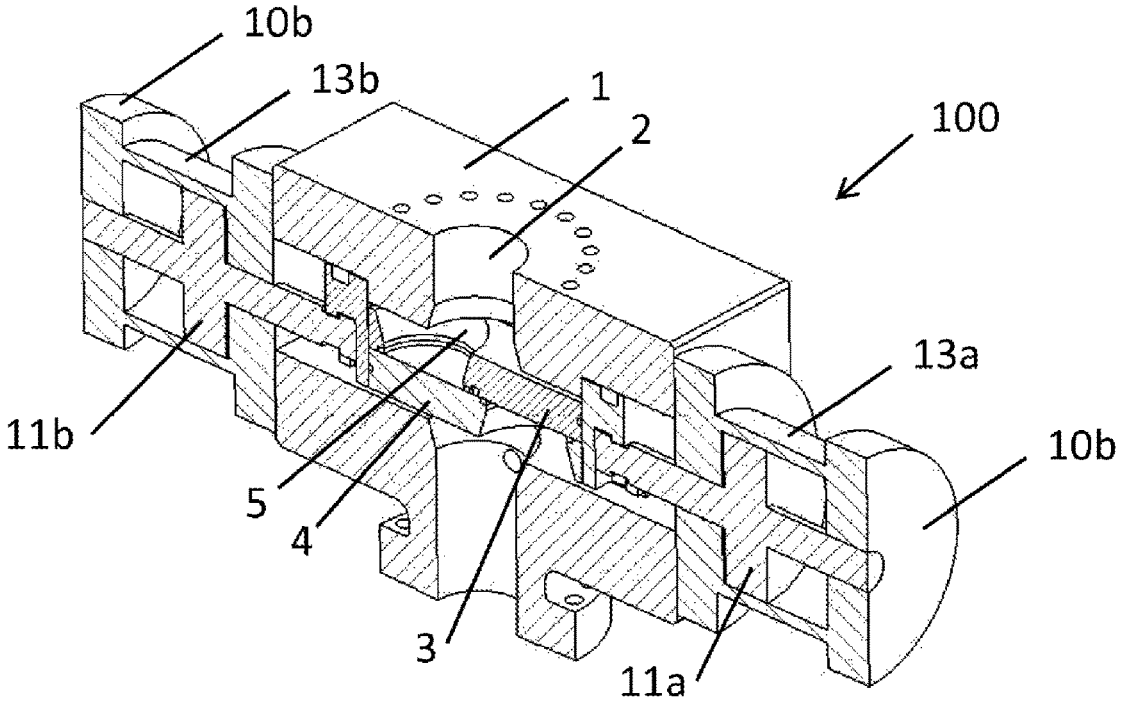
FIG. 2 shows a wellbore control device in a closed position.

FIGS. 1 and 2 show a wellbore control device 100 according to the present invention, which is suitable, for example, for use as a blow-out preventer in a subsea or surface wellhead system. FIG. 1 shows the device in an open position and FIG. 2 in a closed position. The wellbore control device 100 comprises a housing 1 having a throughbore 2. A first gate 3 and a second gate 4 are arranged in the housing 1 and are adapted to move transversely and in different (in this example, opposite) directions in relation to the throughbore 2. The first gate 3 and the second gate 4 have respective holes 5 and 6. In the open position (FIG. 1), the holes 5 and 6 overlap and are aligned substantially co-axially with the throughbore 2 to permit passage through the throughbore 2, for example, of a tubular holding drilling tools (e.g., a drill string). In the closed position (FIG. 2), the first gate 3 and the second gate 4 are moved so that holes 5 and 6 do not overlap and the first gate 3 and the second gate 4 split the throughbore 2 into an upper portion and a completely separate lower portion, thus closing the throughbore 2.

The first gate 3 and the second gate 4 are actuated by actuators 10*a* and 10*b*. In the embodiment shown, actuators 10*a* and 10*b* comprise hydraulic cylinders 13*a* and 13*b* with hydraulic pistons 11*a* and 11*b*, however, actuators 10*a* and 10*b* may also be of a different design, for example, electric. Hydraulic pistons 11*a* and 11*b* may engage the respective first gate 3 and second gate 4 directly through a piston shaft, or via ram elements 12*a* and 12*b* (see FIG. 3).

The first gate 3 and the second gate 4 define a shearing face between them so that upon movement from the open position to the closed position, a tubular (or other equipment) located in the throughbore 2 will be sheared by the edges of holes 5 and 6. The shearing edges of holes 5 and 6 may be provided with a hardened surface compared to the rest of the gate body, for example, by hardened cutting-edge inserts (shown as item 40 in FIGS. 8 and 9). For example, an MP35 material or equivalent may be suitable for this purpose.

In the closed position (FIG. 2), holes 5 and 6 are left in a position where each hole 5 or 6 remains in communication with the throughbore 2. This is achieved by arranging the end ("closed") position of the first gate 3 and the second gate 4 at a position where the section of the first gate 3 and the second gate 4 comprising the holes 5 and 6 are not moved fully out of the throughbore 2 and thus not moved completely into the housing 1. The wellbore control device 100 can alternatively be arranged so that only one of the holes 5 and 6 or part of one of the holes 5 and 6 remain aligned with the throughbore 2, for example, hole 5 in the upper gate 3, whereas hole 6 in the lower gate 4 is moved fully into the housing 1.

Figure 3:
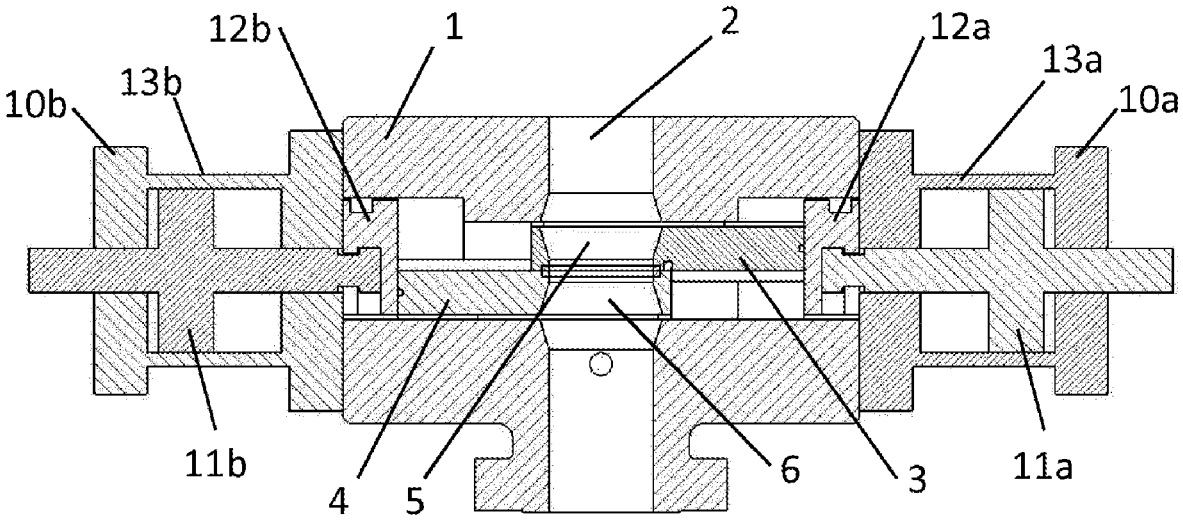
FIG. 3 shows an alternative view of a wellbore control device in an open position.

FIG. 3 shows the same as FIG. 1 in a side view, i.e., a wellbore control device 100 in an open position.

Figure 4:
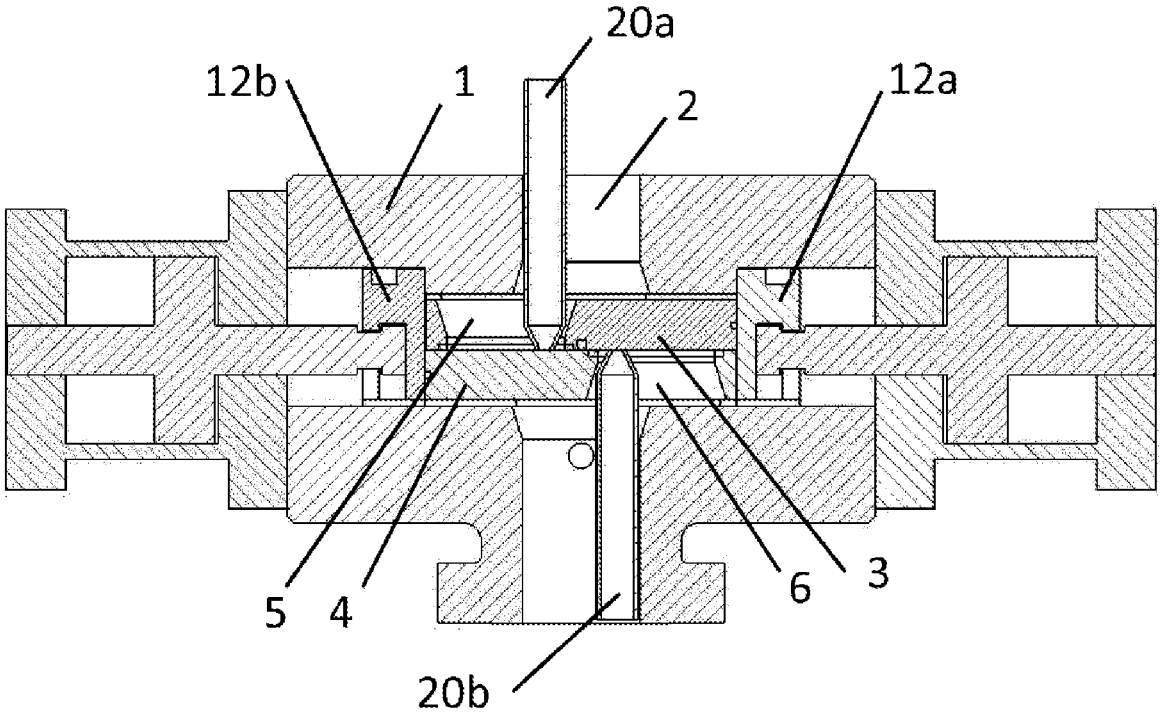
FIG. 4 shows a wellbore control device in a closed position after cutting a tubular object.

FIG. 4 shows the same as FIG. 2 in a side view, i.e., a wellbore control device 100 in a closed position. FIG. 4 also schematically illustrates two cut ends 20*a* and 20*b* of a drill pipe which was present in the throughbore 2 prior to closing which has been sheared by the first gate 3 and the second gate 4. The cut ends of the drill pipe 20*a* and 20*b* are left in holes 5 and 6 when the wellbore control device 100 is in the closed position. This eliminates the need for pipe ends 20*a* and 20*b* to be lifted, removed or subject to a "double cut", i.e., shearing between the upper edge of hole 5/lower edge of hole 6 and the housing 1, which would have been necessary if the first gate 3 and the second gate 4 were to be driven fully into the housing 1.

Figure 5:
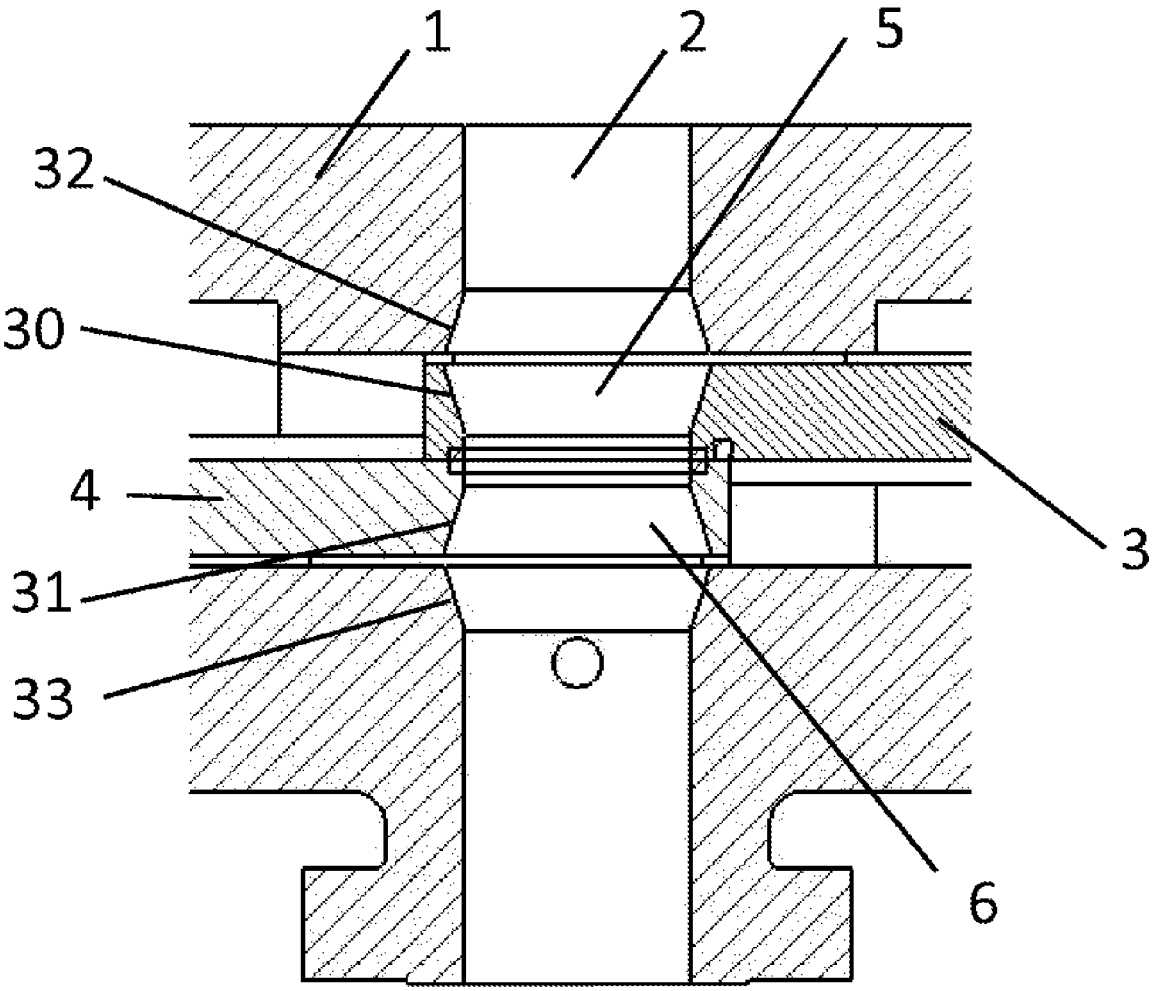
FIG. 5 shows parts of the wellbore control device shown in FIG. 3.

FIG. 5 shows a magnified view of parts of the wellbore control device 100 shown in FIG. 3. In this embodiment of the present invention, a part of one or both holes 5 and 6 has a frustoconical portion 30, 31, whereby the diameter of the holes 5 and/or 6 is larger towards the side facing the housing 1 compared to the side facing the other gate. The frustoconical portions 30 and 31 provide the additional advantage that more space is available for the end of the cut object, e.g., pipe ends 20*a* and 20*b* (see FIG. 4) in the hole 5 or 6 when the wellbore control device 100 is in the closed position.

The throughbore 2 can also be provided with frustoconical portions 32 and/or 33 at a point interfacing the first gate 3 and the second gate 4. The frustoconical portions 32 and/or 33, on their own or in combination with the frustoconical portions 30 and 31, provide the same advantages as those described above, i.e., allowing more space for the cut object in the holes 5 and 6 after closure of the well control device 100. Frustoconical portions 30, 31, 32 and 33 thus provide particular advantages if there is a need to cut large-diameter objects, for example, a casing tubular, as there will be less tendency for the cut pipe end to be deformed when present in the hole 5 or 6 during closing of the first gate 3 and the second gate 4.

Figure 6:
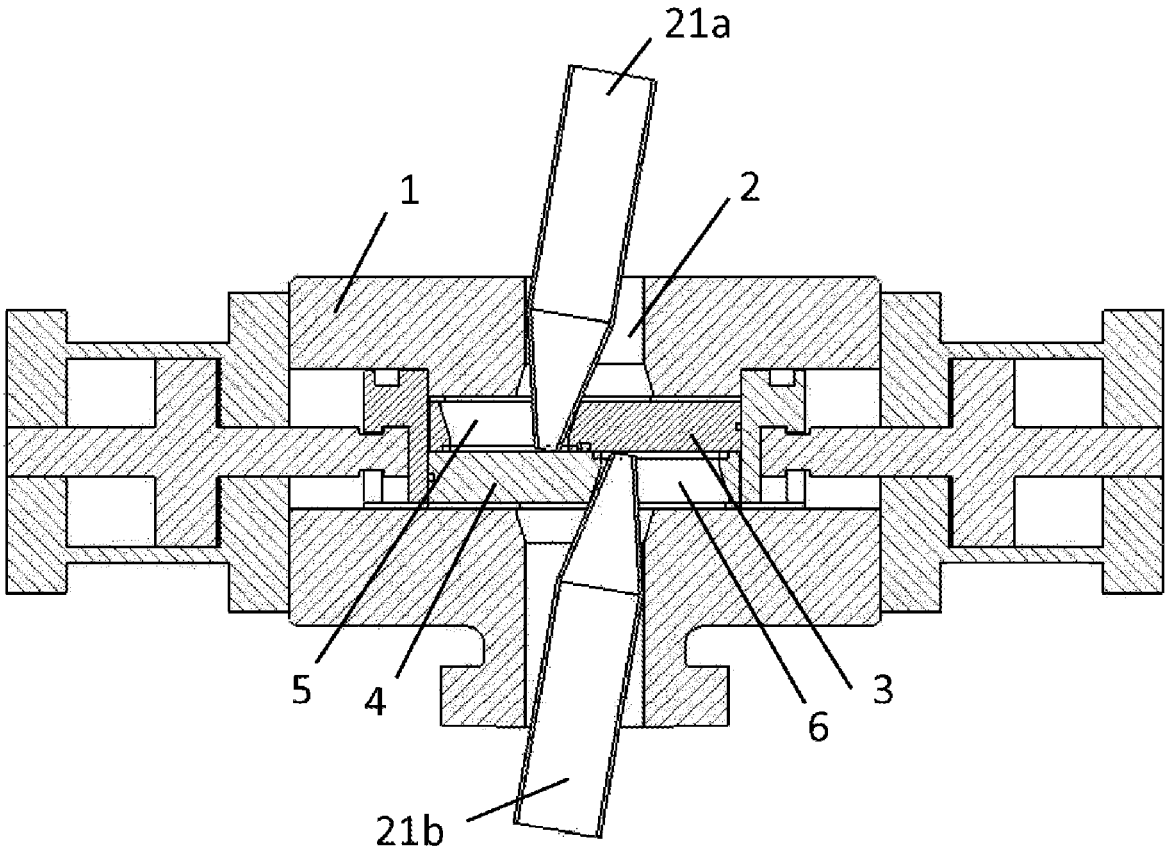
FIG. 6 shows a wellbore control device after cutting a large-diameter tubular object.

FIG. 6 illustrates a situation where the wellbore control device 100 shears a large-diameter tubular object, such as a casing string. In this case, the pipe ends 21*a* and 21*b* will be deformed, but as in the case above, remain partly in the holes 5 and 6.

Figure 7:
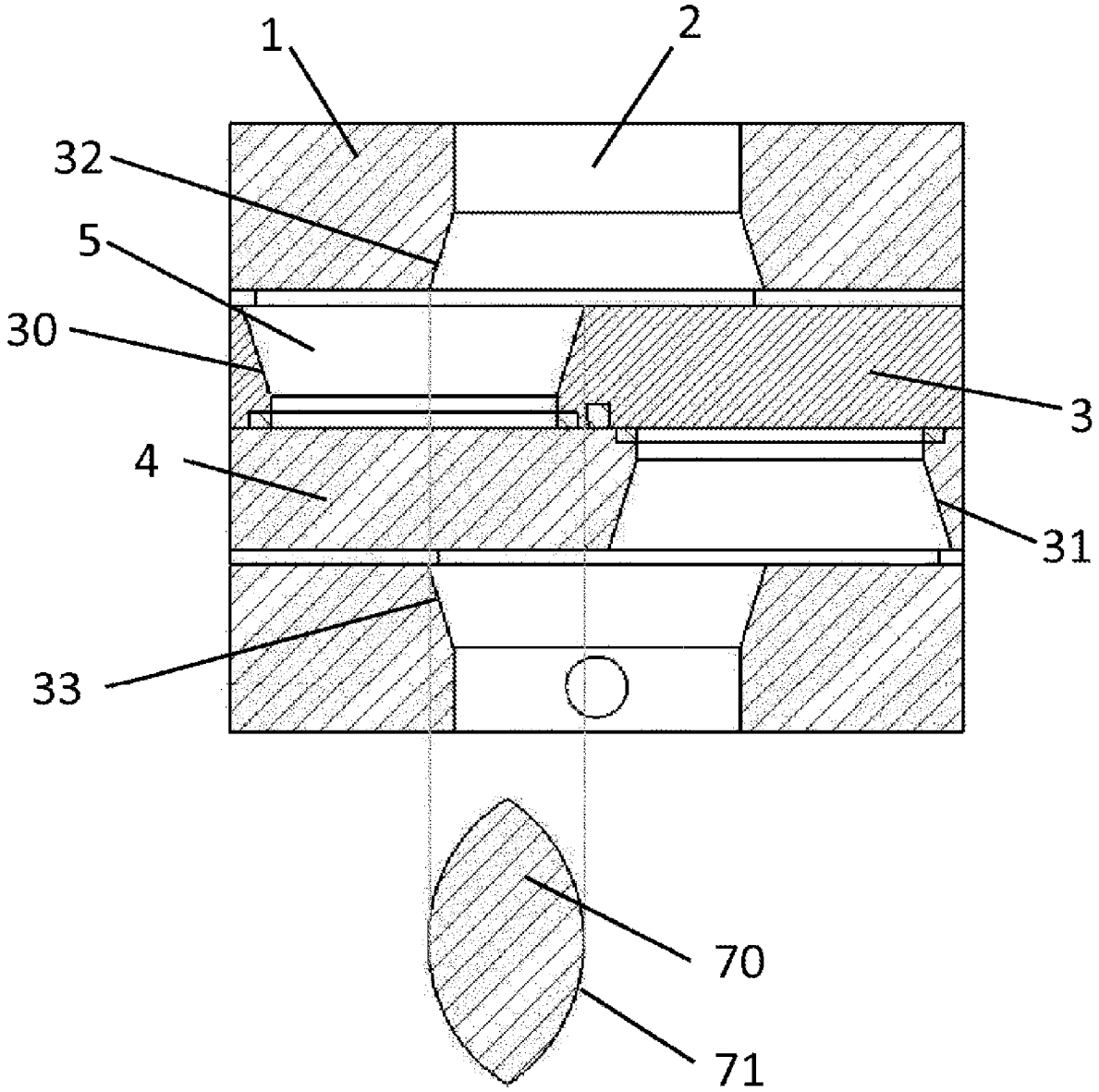
FIG. 7 shows the area interconnecting a hole and the throughbore in the closed position.

FIG. 7 illustrates the area 70 interconnecting the hole 5 of first gate 3 and the throughbore 2 in the closed position. (A similar area will exist for the second gate 4.) With a (circular) hole 5, this area 70 will have the shape of a circle intersection, or vesica piscis. The area 70 will have a circumferential length 71. In an embodiment, the frustoconical portions 30 and 32 are arranged with an appropriate conical angle (i.e., the angle between the frustoconical portions 30 and 32 to the vertical) so that the circumference length 71 is larger than the circumference of the largest tubular object to be sheared by the wellbore control device.

As noted above, when cutting a tubular, the cut end will be deformed, generally into an oval-like shape. Arranging frustoconical portions 30 and 32 with a conical angle large enough to give such a circumferential length 71 in a vesica piscis shaped area allows the cut end to remain in the hole 5 without the need for a double cut or further deformation of the tubular.

In conventional wellbore systems, for example, the throughbore 2 may have a diameter of 18¾". For cutting objects larger than 6⅝" OD, the frustoconical portions can form an increased circumferential length 71 which can allow for cutting and sideways storage of objects up to 14" OD. The objects will be deformed to the circumference and the available shape and space. The wellbore control device according to the present invention is thus, unlike conventional systems, able to cut and seal with various sized tubular present in the throughbore.

Figure 8:
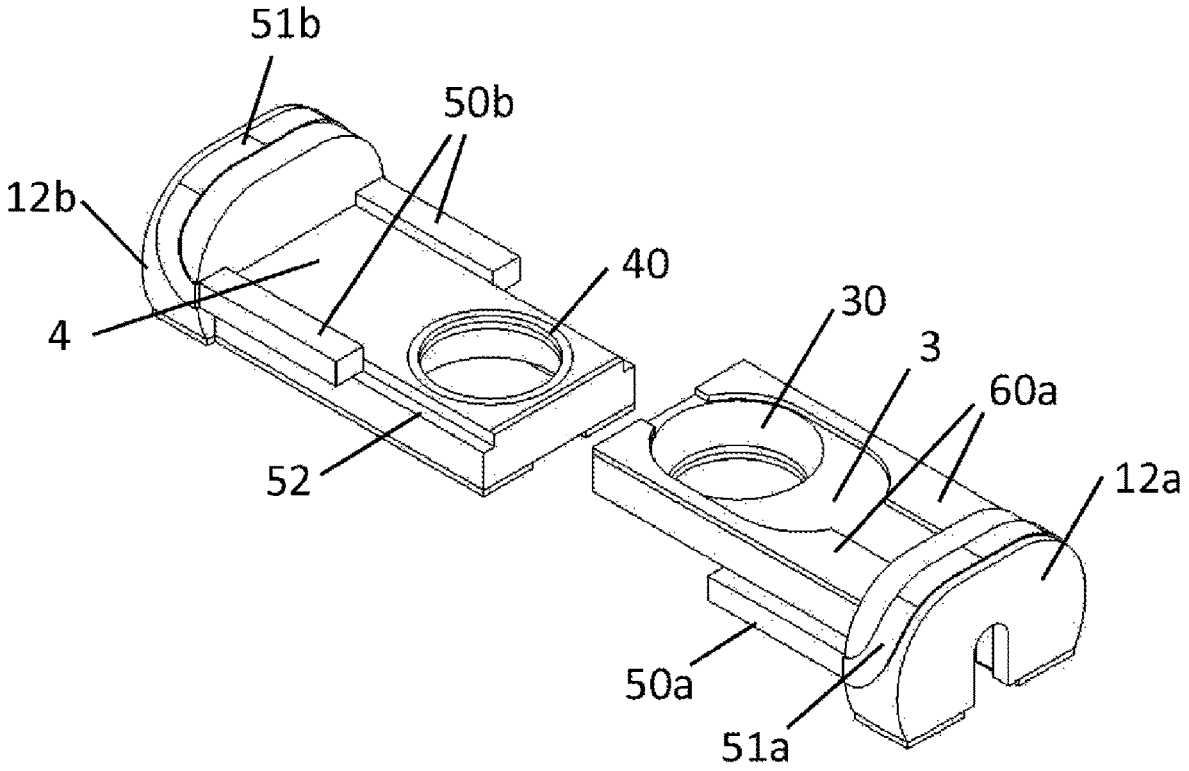
FIG. 8 shows a gate suitable for use in the wellbore control device.
Figure 9:
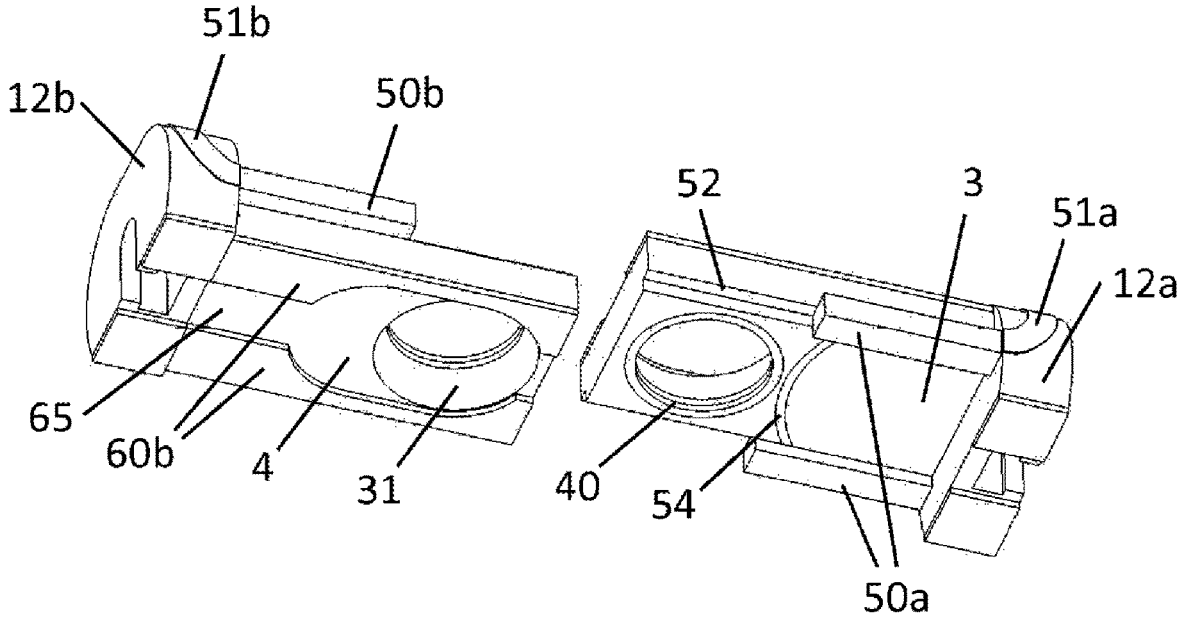
FIG. 9 shows a gate suitable for use in the wellbore control device.

FIGS. 8 and 9 show the cutting assemblies used in a wellbore control device 100 as described above, the cutting assemblies being the moving elements driven by the hydraulic pistons 11*a* and 11*b*, equivalent to the assembly of rams and shearing blades in a conventional blow-out preventer. The cutting assemblies comprise the first gate 3 and the second gate 4 with cutting inserts 40 (described above). The cutting assemblies may further comprise ram elements 12*a* and 12*b* fixed to the first gate 3 and the second gate 4. Ram elements 12*a* and 12*b* provide the advantage of transferring and distributing the force from the hydraulic pistons 11*a* and

11*b* evenly across the first gate 3 and the second gate 4. The ram elements 12*a* and 12*b* may be elements fixed to the first gate 3 and the second gate 4 or the first gate 3 and the second gate 4 may be manufactured in one piece with ram elements 12*a* and 12*b*. Also visible in FIGS. 8 and 9 are frustoconical portions 30 and 31 (described above).

In this embodiment, the cutting assemblies further comprise side seals 50*a* and 50*b* arranged between the first gate 3 and the second gate 4, and back seals 51*a* and 51*b* arranged on the ram elements 12*a* and 12*b*, alternatively (if no ram elements are used) on the back section of each of first gate 3 and second gate 4.

The side seals 50*a* and 50*b* are arranged in seal grooves 52 provided in the first gate 3 and the second gate 4, whereas the back seals 51*a* and 51*b* are arranged in grooves in the ram elements 12*a* and 12*b*. The side seals 50*a* and 50*b* are further received in a housing seal groove 53 (see FIG. 10). A gate seal 54 is arranged in a groove in one of the first gate 3/second gate 4, for example, on the underside of the first (upper) gate 3, to engage with the upperside of the second (lower) gate 4.

The side seals 50*a*, 50*b* and back seals 51*a*, 51*b* provide a substantially fluid-tight seal between the first gate 3, the second gate 4, and the housing 1 to prevent the flow of fluid between the first gate 3/second gate 4 and the housing 1. The gate seal 54 provides a substantially fluid-tight seal between the first gate 3 and the second gate 4 when the first gate 3/second gate 4 are in the closed position. Fluid flow along the throughbore 2 is therefore substantially prevented when the first gate 3/second gate 4 are in the closed position.

Seals 50*a*, 50*b*, 51*a*, 51*b* and 54 may be elastomeric or polymeric seals. Upon closure of the wellbore control device 100, side seals 50*a* and 50*b* will engage each other and be pressed together. The side seals 50*a* and 50*b* are arranged in connection with back seals 51*a* and 51*b* and gate seal 54 so that, upon engagement, due to their elastic properties, the side seals will energise all seals.

Figure 10:
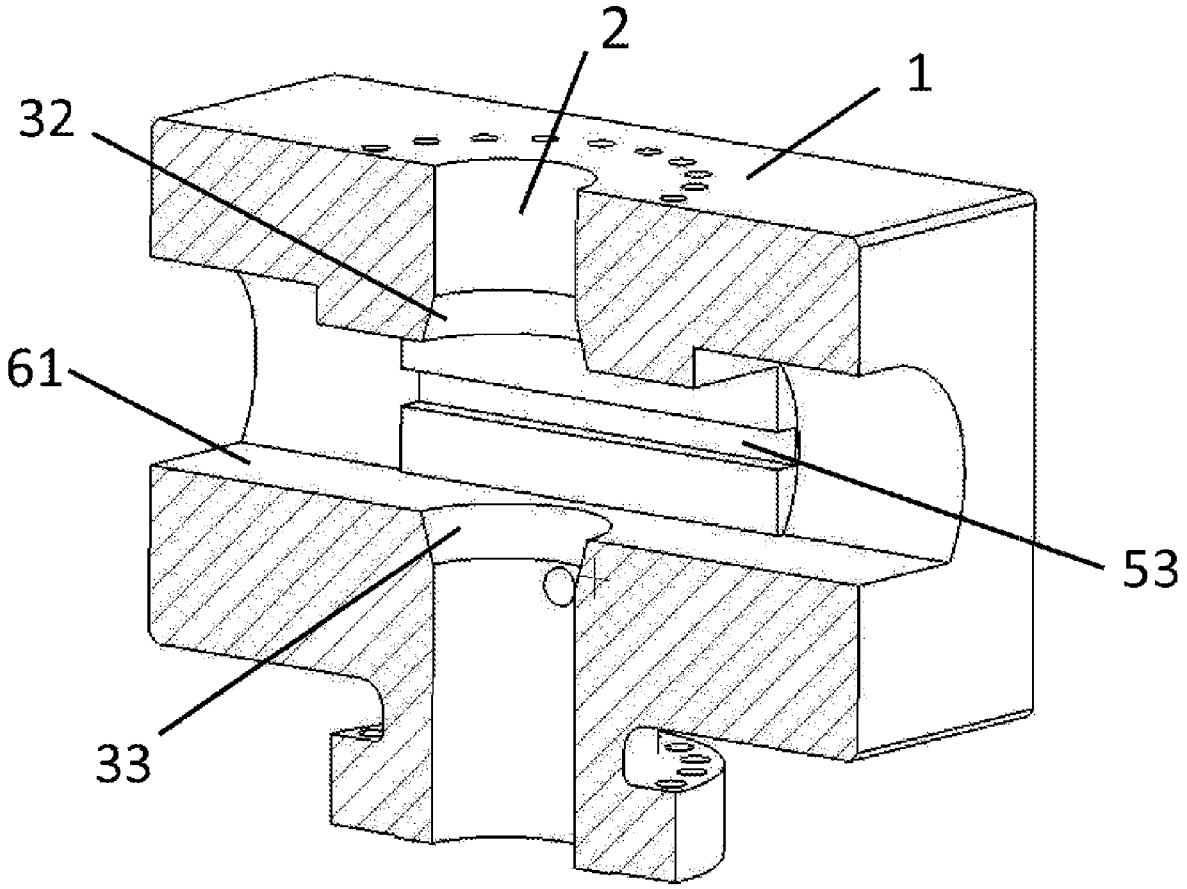
FIG. 10 shows parts of the housing for a wellbore control device.

Providing an elastomeric seal which is energised upon closing provides the advantage that the seals are protected in the seal groove prior to engagement, i.e., they will thus will not be damaged by external objects. This is particularly important for the gate seal 54 where, for example, the cut pipe end may have sharp edges which could destroy the seal. A further advantage can be realised by providing the housing seal groove 53 for the gate seal 54 in a curved shape, as can be seen in FIG. 10. This further reduces the risk that external object present in the throughbore enters the seal groove 52 and damages the seal.

The cutting assemblies may further be provided with slide elements 60*a* and 60*b* on the first gate 3 and the second gate 4 and/or on the ram elements 12*a* and 12*b*. The slide elements 60*a* and 60*b* support the first gate 3 and the second gate 4 towards the housing 1 and thus also carry the load acting on the first gate 3/second gate 4. The slide elements 60*a* and 60*b* may be made in a low friction alloy, such as NiAlCu bronze, or alternatively in a polymer material. The slide elements thus reduce friction between the first gate 3/second gate 4 and the housing 1, and provides a reliable operation also in the case of high vertical loads acting on the first gate 3/second gate 4. Slide elements 60*a*, 60*b* in an appropriate material also eliminates the need for coating (for example, tungsten carbide) on the first gate 3/second gate 4 which would otherwise be necessary to avoid sticking between the first gate 3/second gate 4 and the housing 1 when opening or closing under high loads.

In an embodiment, the slide elements can, for example, be provided with a fluid path 65 connecting, in the closed position, the throughbore 2 to the back side of the ram elements 12*a* and 12*b*. (Or the back end of the first gate 3 and the second gate 4 if ram elements 12*a* and 12*b* are not used.) The fluid path 65 need only be very small and allows the wellbore pressure to act on the back side of the ram elements 12*a* and 12*b*, thus assisting in keeping the wellbore control device 100 locked in the closed position. The fluid path 65 can alternatively be arranged in the housing 1 or in the first gate 3/second gate 4 as a channel or extrusion on the relevant surface.

FIG. 10 shows a section of the housing 1 (similar to that shown in FIG. 5) with throughbore 2, frustoconical portions 32 and 33, and housing seal groove 53. A support face 61 provides vertical support for the gates 3 and 4, via slide element 60*b*.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof. Reference should also be had to the appended claims.

What is claimed is:

1. A wellbore control device comprising:

a housing defining a throughbore, the throughbore being configured to receive a tubular;

a first gate comprising a first hole and a seal groove;

a second gate comprising a second hole and a seal groove; and seals with a single seal being arranged in each of the seal grooves, wherein, the first gate and the second gate are supported by the housing and are configured to perform a movement which is transverse to the throughbore between an open position and a closed position, the movement of the first gate and the second gate from the open position to the closed position splits the throughbore into an upper portion and a lower portion, the upper portion and the lower portion being completely separate from each other, in the open position, the first hole and the second hole are aligned substantially co-axially with the throughbore, in the closed position, a part of at least one of the first hole and the second hole remains aligned with the throughbore, the seals are non-metallic, the seals are arranged to provide a substantially fluid-tight seal between the housing and the first gate and the second gate and between the first gate and the second gate when each of the first gate and the second gate are in the closed position the housing comprises housing seal grooves, the seal grooves are arranged to extend longitudinally along respective sides of the first gate and of the second gate, and the seals are arranged as side seals in the seal grooves and are received in the housing seal grooves so as to provide a substantially fluid-tight seal between the first gate, the second gate and the housing when the first gate and the second gate are in the closed position.

2. The wellbore control device as recited in claim 1, wherein at least one of the first gate and the second gate is shaped so that at least one of the first hole and the second hole is frustoconical or comprises a frustoconical portion.

3. The wellbore control device as recited in claim 2, wherein at least one of the first gate and the second gate is shaped so that a diameter of at least one of the first hole and the second hole is larger towards a side of the respective first gate and second gate facing the housing, and smaller towards a side of the respective first gate and second gate which is adjacent to the other respective first gate and second gate.

4. The wellbore control device as recited in claim 1, wherein at least one of the first gate and the second gate is shaped so that at least one of the first hole and the second hole comprises a shearing edge which is configured to assist in shearing the tubular extending along the throughbore upon the movement of the respective first gate and second gate from the open position to the closed position.

5. The wellbore control device as recited in claim 1, wherein the housing is shaped so that the throughbore comprises a frustoconical portion.

6. The wellbore control device as recited in claim 5, wherein the housing is shaped so that the throughbore comprises two frustoconical portions which are arranged so that the first gate and the second gate are directly adjacent to and supported between the two frustoconical portions of the throughbore.

7. The wellbore control device as recited in claim 6, wherein, the frustoconical portion of the throughbore or at least one of the two frustoconical portions of the throughbore comprises a larger diameter end and a smaller diameter end, the larger diameter end is arranged directly adjacent to at least one of the first gate or the second gate, and the smaller diameter end is arranged away from the respective first gate or second gate.

8. The wellbore control device as recited in claim 1, wherein the seals are elastomeric seals or polymeric seals.

9. The wellbore control device as recited in claim 1, wherein the seals are configured to be energized by side packer seals when the first gate and the second gate reach the closed position.

10. The wellbore control device as recited in claim 1, wherein, the first gate further comprises a gate seal groove arranged in a lower side of the first gate or the second gate further comprises a gate seal groove arranged in an upper side of the second gate, and the first gate is arranged above the second gate, and further comprising:

a gate seal arranged in the gate seal groove, the gate seal being configured to engage with the lower side of the first gate if arranged in the gate seal groove arranged in the upper side of the second gate or with the upper side of the second gate if arranged in the gate seal groove arranged in the lower side of the first gate to provide a substantially fluid-tight seal between the first gate and the second gate when the first gate and the second gate are in the closed position.

11. The wellbore control device as recited in claim 10, further comprising:

a first actuator;

a second actuator;

a first ram element arranged between the first actuator and the first gate; and a second ram element arranged between the second actuator and the second gate.

12. The wellbore control device as recited in claim 11, further comprising:

back seals, wherein, the first ram element comprises a back seal groove, the second ram element comprises a back seal groove, one of the back seals is arranged in the back seal groove of the first ram element, one of the back seals is arranged in the back seal groove of the second ram element, the housing comprises housing seal grooves, the seal grooves are arranged to extend longitudinally along respective sides of the first gate and of the second gate, the seals are arranged as side seals in the seal grooves and are received in the housing seal grooves, each of the back seals, the gate seal, and the side seals are elastomeric or polymeric, the side seals are configured to engage each other and be pressed together in the closed position, and the side seals, the back seals and the gate seal are arranged so that, in the closed position, the side seals will energize each other, the back seals and the gate seal so as to provide a substantially fluid-tight seal between the first gate, the second gate and the housing and between the first gate and the second gate.

13. The wellbore control device as recited in claim 1, wherein the seal groove has a semi-circular shape.

14. The wellbore control device as recited in claim 1, further comprising:

a slide element arranged between the first gate and the housing and between the second gate and the housing.

15. The wellbore control device as recited in claim 14, wherein the slide element comprises a fluid path which extends from the first hole towards a back section of the first gate and from the second hole towards a back section of the second gate.

16. The wellbore control device as recited in claim 1, further comprising:

a first piston rod configured to actuate the first gate; and a second piston rod configured to actuate the second gate, wherein, the first piston rod and the second piston rod are arranged along a common axis.

17. The wellbore control device as recited in claim 1, wherein, the first gate further comprises a first recess configured to receive a front part of the second gate, and the second gate comprises a second recess configured to receive a front part of the first gate.

18. The wellbore control device as recited in claim 17, wherein, the first recess comprises a rear wall, the second gate further comprises a front wall, and the first recess is configured to abut the front wall in the closed position.

19. An assembly comprising:

the wellbore control device as recited in claim 1; and a tubular which extends along the throughbore in the housing of the wellbore control device, wherein, each portion of at least one of the first hole and second hole which remain aligned with the throughbore when the first gate and the second gate are in the closed position define a connecting area comprising a circumferential length which is larger than a circumference of the tubular.

20. A method of using the wellbore control device as recited in claim 1 to sever a tubular extending along the throughbore and through the first hole in the first gate and through the second hole in the second gate, the method comprising:

moving the first gate in a first direction generally transverse to the throughbore, and moving the second gate in a second direction generally transverse to the throughbore.

21. A wellbore control device comprising:

a housing defining a throughbore, the throughbore being configured to receive a tubular;

a first gate comprising a first hole and a seal groove;

a second gate comprising a second hole and a seal groove;

seals with a single seal being arranged in each of the seal grooves; and a slide element arranged between the first gate and the housing and between the second gate and the housing, wherein, the first gate and the second gate are supported by the housing and are configured to perform a movement which is transverse to the throughbore between an open position and a closed position, the movement of the first gate and the second gate from the open position to the closed position splits the throughbore into an upper portion and a lower portion, the upper portion and the lower portion being completely separate from each other, in the open position, the first hole and the second hole are aligned substantially co-axially with the throughbore, in the closed position, a part of at least one of the first hole and the second hole remains aligned with the throughbore, the seals are non-metallic, the seals are arranged to provide a substantially fluid-tight seal between the housing and the first gate and the second gate and between the first gate and the second gate when each of the first gate and the second gate are in the closed position, and the slide element comprises a fluid path which extends from the first hole towards a back section of the first gate and from the second hole towards a back section of the second gate.

22. A wellbore control device comprising:

a housing defining a throughbore, the throughbore being configured to receive a tubular;

a first gate comprising a first hole and a seal groove;

a second gate comprising a second hole and a seal groove;

seals with a single seal being arranged in each of the seal grooves;

a first piston rod configured to actuate the first gate; and a second piston rod configured to actuate the second gate, wherein, the first gate and the second gate are supported by the housing and are configured to perform a movement which is transverse to the throughbore between an open position and a closed position, the movement of the first gate and the second gate from the open position to the closed position splits the throughbore into an upper portion and a lower portion, the upper portion and the lower portion being completely separate from each other, in the open position, the first hole and the second hole are aligned substantially co-axially with the throughbore, in the closed position, a part of at least one of the first hole and the second hole remains aligned with the throughbore, the seals are non-metallic, the seals are arranged to provide a substantially fluid-tight seal between the housing and the first gate and the second gate and between the first gate and the second gate when each of the first gate and the second gate are in the closed position, and the first piston rod and the second piston rod are arranged along a common axis.

23. A wellbore control device comprising:

a housing defining a throughbore, the throughbore being configured to receive a tubular;

a first gate comprising a first hole and a seal groove;

a second gate comprising a second hole and a seal groove; and seals with a single seal being arranged in each of the seal grooves, wherein, the first gate and the second gate are supported by the housing and are configured to perform a movement which is transverse to the throughbore between an open position and a closed position, the movement of the first gate and the second gate from the open position to the closed position splits the throughbore into an upper portion and a lower portion, the upper portion and the lower portion being completely separate from each other, in the open position, the first hole and the second hole are aligned substantially co-axially with the throughbore, in the closed position, a part of at least one of the first hole and the second hole remains aligned with the throughbore, the seals are non-metallic, the seals are arranged to provide a substantially fluid-tight seal between the housing and the first gate and the second gate and between the first gate and the second gate when each of the first gate and the second gate are in the closed position, the first gate further comprises a first recess configured to receive a front part of the second gate, and the second gate comprises a second recess configured to receive a front part of the first gate.

24. A wellbore control device comprising:

a housing defining a throughbore, the throughbore being configured to receive a tubular;

a first gate comprising a first hole and a seal groove;

a second gate comprising a second hole and a seal groove;

seals with a single seal being arranged in each of the seal grooves;

back seals;

a first actuator;

a second actuator;

a first ram element arranged between the first actuator and the first gate; and a second ram element arranged between the second actuator and the second gate, wherein, the first gate further comprises a gate seal groove arranged in a lower side of the first gate or the second gate further comprises a gate seal groove arranged in an upper side of the second gate, and the first gate is arranged above the second gate, and further comprising:

a gate seal arranged in the gate seal groove, the gate seal being configured to engage with the lower side of the first gate if arranged in the gate seal groove arranged in the upper side of the second gate or with the upper side of the second gate if arranged in the gate seal groove arranged in the lower side of the first gate to provide a substantially fluid-tight seal between the first gate and the second gate when the first gate and the second gate are in the closed position, wherein, the first gate and the second gate are supported by the housing and are configured to perform a movement which is transverse to the throughbore between an open position and a closed position, the movement of the first gate and the second gate from the open position to the closed position splits the throughbore into an upper portion and a lower portion, the upper portion and the lower portion being completely separate from each other, in the open position, the first hole and the second hole are aligned substantially co-axially with the throughbore, in the closed position, a part of at least one of the first hole and the second hole remains aligned with the throughbore, the seals are non-metallic, the seals are arranged to provide a substantially fluid-tight seal between the housing and the first gate and the second gate and between the first gate and the second gate when each of the first gate and the second gate are in the closed position, the first ram element comprises a back seal groove, the second ram element comprises a back seal groove, one of the back seals is arranged in the back seal groove of the first ram element, one of the back seals is arranged in the back seal groove of the second ram element, the housing comprises housing seal grooves, the seal grooves are arranged to extend longitudinally along respective sides of the first gate and of the second gate, the seals are arranged as side seals in the seal grooves and are received in the housing seal grooves, each of the back seals, the gate seal, and the side seals are elastomeric or polymeric, the side seals are configured to engage each other and be pressed together in the closed position, and the side seals, the back seals and the gate seal are arranged so that, in the closed position, the side seals will energize each other, the back seals and the gate seal so as to provide a substantially fluid-tight seal between the first gate, the second gate and the housing and between the first gate and the second gate.

* * * * *